US005755353A

United States Patent [19]

Zampella et al.

[11] Patent Number: 5,755,353

[45] Date of Patent: May 26, 1998

[54] STEEL DRUM WITH FLATTENED ROLLING HOOPS

[75] Inventors: Steve Zampella, South Plainfield; Robert E. Caskey, Ocean Port, both of N.J.

[73] Assignee: Russell-Stanley Corporation, Red Bank, N.J.

[21] Appl. No.: 260,563

[22] Filed: Jun. 16, 1994

[51] Int. Cl.[6] ..... B65D 7/42

[52] U.S. Cl. ..... 220/619

[58] Field of Search ..... 220/619

[56] References Cited

U.S. PATENT DOCUMENTS 3,907,152 9/1975 Wessely .
3,927,790 12/1975 Chase et al. .
3,949,877 4/1976 Santoni .
3,957,171 5/1976 Besser .
3,985,257 10/1976 Shaffer et al. .
4,140,236 2/1979 Uhlig et al. .
4,215,089 7/1980 Uhlig et al. .
4,257,527 3/1981 Snyder et al. .
4,294,374 10/1981 Ames .
4,781,301 11/1988 Le Bret et al. .
4,921,116 5/1990 Troughton et al. .

*Primary Examiner*—Joseph M. Moy
*Attorney, Agent, or Firm*—Hedman, Gibson & Costigan, P.C.

[57] ABSTRACT

A steel drum having a cylindrical body with rolling hoops at about ⅓ and ⅔ of the height of the drum, the rolling hoops having a flattened outer surface and a diameter no greater than 23¼ inches, where the diameter of the cylindrical body is consistent except for the areas of the rolling hoops. Other than a reduced diameter rolling hoop and a retooled swedger, all dimensions of the drum, tools and materials for manufacture are the same as a standard steel drum.

9 Claims, 3 Drawing Sheets

STEEL DRUM WITH FLATTENED ROLLING HOOPS

FIELD OF THE INVENTION

The present invention relates to the field of containers and more specifically steel drums for transporting materials.

BACKGROUND OF THE INVENTION

The fifty-five (55) gallon steel drum has long been a standard container for transporting materials. The standard 55 gallon steel drum has a head, a bottom and a cylindrical middle section with two rounded rolling hoops, one each at about ⅓ and ⅔ of the height of the drum. The standard 55 gallon drum measures 34⅜ inches in total height and has a diameter of 23 15/32 inches at the rolling hoops.

However, these dimensions have proven troublesome wherein the diameter at the rolling hoops does not allow the standard drums to be placed four (4) abreast in a standard ISO overseas shipping container. U.S. Pat. Nos. 4,921,116 to Troughton et al and 4,781,301 to LeBret et al both recognize this problem and provide alternative structures for dealing with it.

U.S. Pat. No. 4,921,116 describes a steel drum with two rolling hoops having narrowed diameters. The drum body section above the top rolling hoop and the section below the bottom rolling hoop are described as having a greater diameter than the middle section to adjust for reduced volume. However, the configuration of the '116 patent requires major tooling and process modifications from those currently being employed to shape the upper and lower sections of the drum body to the greater diameter required. Additionally, larger covers and bottoms, as well as corresponding tooling, are required to seam the cover and bottom of greater diameter to match the increased diameter top and bottom sections of the body.

U.S. Pat. No. 4,781,301 describes a steel drum with a narrowed rolling hoop diameter having corrugated sides. To make up for a smaller diameter rolling hoop the drum of the '301 patent includes additional corrugations across the drum body. However, the corrugations require additional processing, and additional material. Also, the added corrugations increase the problem areas when a full drum is dropped since the rounded rolling hoops tend to be the point of failure in a drop test.

Additionally, unless the diameter is small enough that the drums fit easily, the rounded rolling hoops of both the '116 and '301 patents have a tendency to ride-up on the hoops of adjacent drums when placed four (4) across in an ISO container. On the other hand, if the diameter is made small to avoid the rolling hoops from riding up on one another, additional bracing will be required in the ISO container.

SUMMARY OF THE INVENTION

It is therefore an object of the present invention to provide a 55 gallon steel drum which will fit four (4) abreast in an ISO shipping container with minimum bracing in the ISO container. It is also an object to provide such a drum which has the volume and dimensions of a standard 55 gallon drum and can be made out of the same size pieces of material with the same equipment and process as the standard drum.

Other objects include a drum which has similar or superior performance characteristics to the standard drum and a rolling hoop which will bear against an adjacent hoop rather than stride it when packed tightly.

These and other objects are achieved with the metal drum of the present invention comprising a top, a bottom and a cylindrical body, said cylindrical body having thereon a rolling hoop having a substantially flattened face, wherein the diameter of the rolling hoop is not greater than 23¼ inches and is deformable from a circular to an elliptical configuration. As such, other than the shape of the swedger tooling, the material, equipment and processing currently involved in the manufacture of the drums of the prior art need not be modified to produce the drum of the present invention.

Moreover, the preferred drum has two rolling hoops, at about ⅓ and ⅔ of the height of the drum, as with the standard drum of the prior art making the drums of the present invention compatible with the drums of the prior art.

BRIEF DESCRIPTION OF THE DRAWINGS

The annexed drawings, in which like reference characters represent like parts, are intended to illustrate the present invention without limiting the invention in any manner whatsoever.

DETAILED DESCRIPTION OF THE PREFERRED EMBODIMENT

Figure 1:
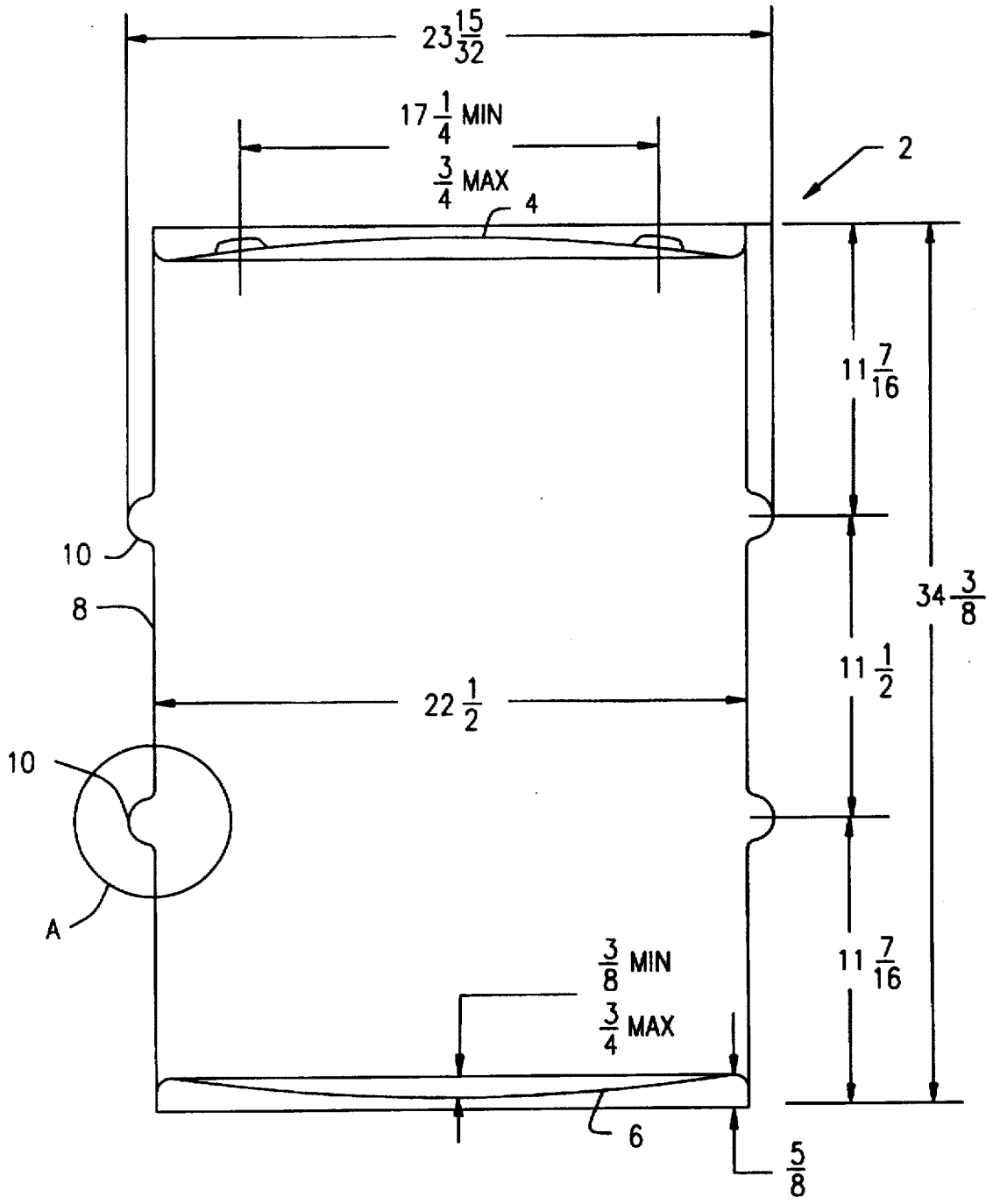
(PRIOR ART) FIG. 1
FIG. 1 is an elevation view in cross section of the standard 55 gallon drum of the prior art.

The prior art 55 gallon steel drum 2, as shown in FIG. 1, has a cover 4, a bottom 6 and a cylindrical body 8 therebetween. The cylindrical body 8 has two rolling hoops 10 at approximately one-third and two-thirds of the height of the drum 2.

The dimensions of the standard 55 gallon steel drum of the prior art include a height of 34⅜ inches, diameter of the cylinder body of 22½ inches and diameter of the rolling hoop of 23 15/32 inches. The upper rolling hoop is 11 7/16 inches from the top of the drum 2 and the lower rolling hoop is 11 7/16 inches from the bottom of the finished drum 2 with 11½ inches between the rolling hoops.

Figure 2:
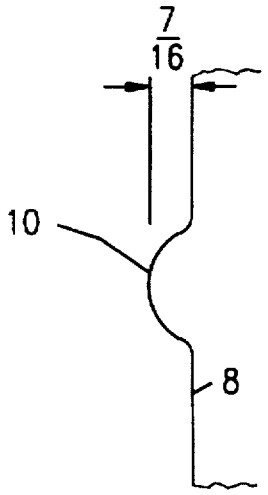
(PRIOR ART) FIG. 2
FIG. 2 is a partial elevation in cross section of the rolling hoop of the prior art drum in the area of A on FIG. 1.

The cylinder body 8 is welded into a circular configuration from a sheet of cold rolled steel, generally 18 or 20 gauge ASTM 1060, commercial class 1, which is 35¾ inches high by 70¾ inches wide. Once the cylindrical body 8 is welded into a circular configuration, the rolling hoops 10 are then formed with a swedger to create an arcuate bump, as shown in FIG. 2, having a radius of about ½ inch so that the outer edge of the rolling hoop protrudes 7/16 of an inch beyond the cylinder body 8. The head 4 and bottom 6, each having a diameter of about 22½ inches to fit within the top and bottom ends of the cylinder body 8, are then attached to the cylinder body 8 with a closed chime.

Figure 3:
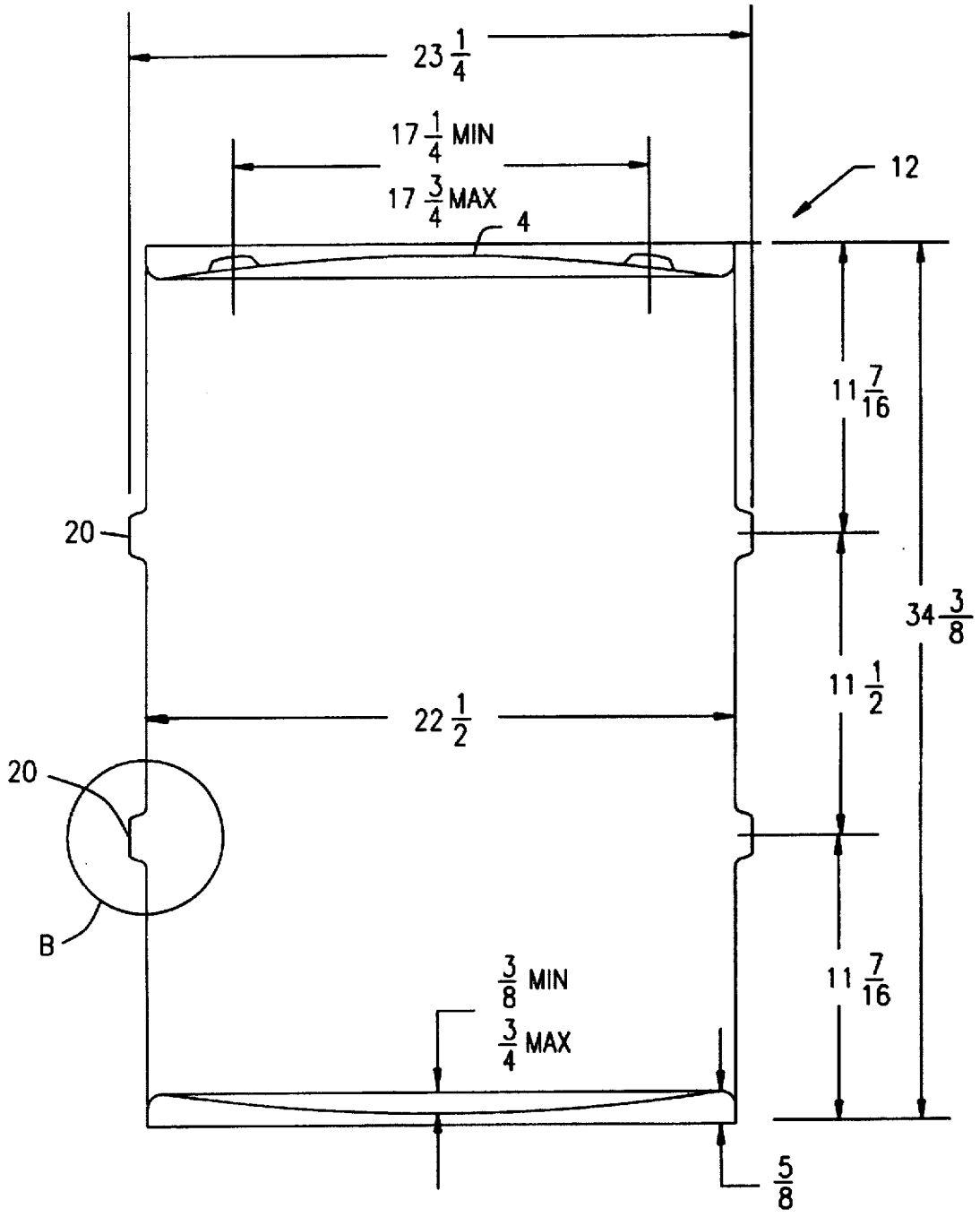
FIG. 3 is an elevational view in cross section of the drum of the present invention.

The preferred drum 12 of the present invention, shown in FIG. 3, is made from the same sheet of material having the same dimensions as the drum 2 of the prior art, i.e. 35¾ inches by 70¾ inches. The height of the preferred drum 12 is 34⅜ inches and the cylinder body 18 has a diameter of 22½ inches, as with the prior art drum 2. The head 4 and bottom 6 are the same size as with the prior art drum 2 since the cylinder body 8 of the present drum 12 is the same as the prior art. Similarly, the upper and lower rolling hoops 20 are placed at approximately 11 7/16 inches from the top and bottom of the finished drum 12, respectively, with 11½ inches between the two rolling hoops 20.

However, the swedger tooling used to form the rolling hoops 20 of the present drum 12 is not arcuate as with the formation of the prior art rolling hoops 10. Rather, the swedger tooling used to form the preferred rolling hoops 20 of the present invention have a flattened face from about ½ inch to about 1½ inches in width, and most preferred approximately ¾ of an inch in width. The edges of the swedger tool adjacent the flattened area have a tight radius, only enough to avoid the material stress in forming a 90° corner, with 1/16 to ⅛ of an inch being preferred.

Figure 4:
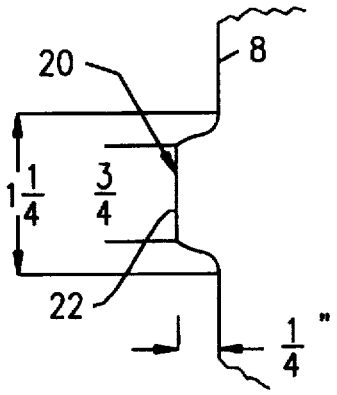
FIG. 4 is a partial elevation in cross section of the rolling hoop of the drum of the present invention in the area of B on FIG. 3.

The flattened face swedger tool creates the preferred rolling hoop 20 formed on the drum 12 having a flattened portion 22, as shown in FIG. 4. The flattened portion 22 of the preferred rolling hoop 20 of the present invention is about ¾ of an inch wide but only extends about ¼ of an inch outwardly from the cylinder body 8. Therefore, although the rolling hoop 20 of the present drum 12 is wider than the rolling hoop 10 of the prior art drum 2, it does not extend as far outwardly, keeping the amount of steel used, the overall drum dimensions and drum volume consistent with the prior art drum 2. This modification, however, provides that the total diameter of the preferred drum 12 of the present invention at the rolling hoop 20 is about 23¼ inches.

Additionally, the flattened portion 22 of the rolling hoops 20 of the present drum 12 provides a bearing surface so that two adjacent drums 12 can be slid together in a tight environment bearing on the rolling hoops 20. This eliminates the problem of the prior art where the rounded rolling hoop 10 of one drum 2 would ride-up on the rolling hoop 10 of an adjacent drum 2 when packed tightly.

The aspect of a flattened rolling hoop 20 creating a bearing surface is especially important wherein the combined diameters of four (4) of the present drums 12 side by side, i.e. 93 inches, is slightly larger than the width of an ISO container, i.e. 92 inches. Moreover, the drum 12 of the present invention having flattened rolling hoops 20 allows for the circular configuration of the rolling hoops 20 of the drum 12 to be deformed into an elliptical configuration when placed four (4) across in a shipping container. The deformation of rolling hoop 20 upon tight packing minimizes the need for additional lateral bracing within the ISO container.

Additionally, the flattened section 22 of the rolling hoop 20 imparts additional stacking and dropping strength to the present drums 12. Due to the radial configuration of the prior art rolling hoop 10, the hoop 10 is more likely to collapse under stacking load or when dropped. However, due to the flattened section 22 the rolling hoop 20 of the present drum 12 resists collapse better than the rolling hoop 10 of the prior art drum 2.

Although alternative embodiments will be apparent to those skilled in the art reading the above disclosure, all such variations are intended to be included within the spirit and scope of the present invention, limited only by the appended claims.

All patents cited herein are incorporated by reference.

We claim:

1. A drum comprising a cylindrical steel body having a height and a diameter and including an upper rolling hoop and a lower rolling hoop, each of said rolling hoops having a substantially flattened outer surface and a diameter at said outer surface of not more than about 23¼ inches;

a steel head; and a steel bottom wherein the diameter of the cylindrical steel body is constant with the exception of the area of the rolling hoops and further wherein the rolling hoops are deformable from a circular configuration to an elliptical configuration when squeezed into an area adjacent a like drum, with said flattened areas of adjacent rolling hoops contacting each other as bearing surfaces.

2. The drum of claim 1 wherein the diameter at the substantially flattened outer surface of the rolling hoop is 23¼ inches.

3. The drum of claim 1 wherein the flattened area of the rolling hoops is from about ½ inch to about 1½ inches wide about the diameter of the cylindrical body.

4. The drum of claim 1 wherein the flattened area of the rolling hoops is about ¾ of an inch wide.

5. The drum of claim 1 wherein the head and the bottom are attached to the cylindrical body with a closed chime having a diameter not greater than the diameter of the rolling hoops.

6. The drum of claim 1 wherein the cylindrical steel body is made from a sheet of ASTM 1060 cold rolled steel 35¾ inches high and 70¾ inches wide.

7. The drum of claim 1 wherein the diameter of the cylindrical body above the upper rolling hoop, below the lower rolling hoop and between the upper and lower rolling hoops is about 22½ inches.

8. The drum of claim 1 wherein four (4) of said drums fit across the width in a standard ISO shipping container with the flattened rolling hoops of adjacent drums contacting on the flattened outer surface.

9. The drum of claim 8 wherein the rolling hoops of said drum are fixed in an elliptical configuration when four (4) across in a standard ISO shipping container.

* * * * *